United States Patent [19]

Mahon

[11] Patent Number: 4,667,616

[45] Date of Patent: May 26, 1987

[54] BOAT DRAIN

[76] Inventor: Robert M. Mahon, 1708 N. 26th St., Broken Arrow, Okla. 74012

[21] Appl. No.: 657,830

[22] Filed: Oct. 5, 1984

[51] Int. Cl.[4] ..... B63B 13/00

[52] U.S. Cl. ..... 114/183 R; 114/184; 114/185

[58] Field of Search ..... 114/183 R, 184, 185

[56] References Cited

U.S. PATENT DOCUMENTS

| | | | |
|---|---|---|---|
| 2,565,885 | 8/1951 | Reitz | 114/185 |
| 2,575,698 | 11/1951 | Wilson | 114/185 |
| 2,608,160 | 8/1952 | Moody | 114/185 |
| 2,672,113 | 3/1954 | McCartney | 114/185 |
| 2,771,052 | 11/1956 | Halverson | 114/185 |
| 2,834,312 | 5/1958 | Baxter | 114/185 |
| 2,866,431 | 12/1958 | Conover | 114/185 |
| 3,180,301 | 4/1985 | Kelver | 114/185 |
| 3,460,503 | 8/1969 | Chalmers | 114/185 |

*Primary Examiner*—Joseph F. Peters, Jr.

*Assistant Examiner*—C. T. Bartz

*Attorney, Agent, or Firm*—Head Johnson Stevenson

[57] ABSTRACT

An automatic boat drain for siphoning water from the interior of a boat, the drain including a flow tube secured to the exterior of the boat transom with the inlet end of the flow tube being below the water surface and oriented so that water is forced to flow through the flow tube as the boat moves forward above a minimum speed, the outlet end of the flow tube being above the water surface, an entraining tube having the inlet end adjacent the interior bottom of the boat, and a venturi forming connection positioned above the water surface connecting the entraining tube outlet end to the flow tube adjacent to and spaced from the flow tube outlet end whereby as the boat moves through water the flow of water forced through the flow tube will produce a venturi effect to drain water from the boat interior while the venturi positioned above the water surface prevents the possibility of water being siphoning into the boat.

3 Claims, 4 Drawing Figures

BOAT DRAIN

SUMMARY OF THE INVENTION

A continuous problem with a boat is that of keeping water from accumulating in the bottom of the boat. Even if a boat is completely water tight, water can enter the boat from rain, from spray and from swimmers entering the boat.

Electric driven bilge pumps are available but they are expensive and require a source of electrical energy to drive them. In addition, most boats have a normal drain opening in the boat transom adjacent the bottom. If this drain opening is opened while the boat is moving above a minimum speed, water will be drained from the boat; however, a serious problem with these drains is that it is easy to forget to replace the drain closure when the boat stops or is moving below the minimum speed. When this happens the boat can soon be flooded.

In order to overcome these problems others have provided various kinds of siphoning devices. For instances, U.S. Pat. Nos. 2,120,858 and 2,479,783 each disclose a device in the form of a hose having a venturi forming connection at the outer end. The hose is drug through the water and when the boat moves above a minimum speed suction is applied to the hose so that water is vented from the boat. The problem with these devices is that most boat owners do not want to drag a hose-type device behind the boat and, in addition, they must remember to put it out when it is necessary to drain water and take it back in at other times so that it will not be fouled with the boat propeller.

To prevent the necessity of dragging a siphoning forming device behind the boat, U.S. Pat. Nos. 2,771,052 and 2,834,312 show siphoning devices affixed to the boat outboard motor. These devices require connections with the outboard motor and are therefore troublesome to install and maintain.

The ideal means for emptying water from the interior of a boat is a steady state device wherein it is not required that the boat operator remember to activate it and which does not require electrical energy or any mechanism trailing behind the boat. U.S. Pat. No. 2,565,885 shows such a device, however, it has a serious problem. The level of the water outside a boat is always above the interior boat bottom. Since the water level is higher outside the boat than inside, the possibility of reverse siphoning exists and in the device shown in U.S. Pat. No. 2,565,885 reverse siphoning could quickly fill the interior of the boat. Reverse siphoning is also possible in the devices shown in U.S. Pat. Nos. 2,834,312 and 2,771,052.

U.S. Pat. No. 2,866,431 illustrates a static type device which functions to empty the boat interior of water automatically when the boat moves forward. A problem with this device however is that it requires two holes to be formed in the boat, one in the boat bottom and one in the boat transom. The hole in the boat bottom receives an apparatus which extends below the boat bottom. If this apparatus is struck by an object in the water, or by a rock, it would be likely to be broken off potentially causing a leak. The mechanism of U.S. Pat. No. 2,866,431 is rather complicated and expensive to install in a boat.

The present invention overcomes the problems with the prior art as exemplified in these previously issued United States patents and provides a static device for removing water from a boat in which it is not necessary to trail an object behind the boat; in which the possibility of reverse siphoning is eliminated; in which it is not necessary to form a hole in the bottom of the boat; and which is extremely simple to install on any type of pleasure boat having a transom.

The invention is in the form of a flow tube which is secured to the exterior surface of the boat transom. The flow tube has an outlet end and an inlet end with the inlet end extending below the water surface and preferably below the boat bottom immediately forwardly of the transom. The inlet end is opened in the direction towards the boat bow end so that when the boat moves through water above a minimum speed water is forced to flow through the flow tube, entering the inlet end and flowing out the outlet end. An entraining tube is positioned within interior of the boat. The entraining tube has an inlet end which is positioned adjacent the boat interior bottom. A venturi forming connection is positioned above the water surface and between the entraining tube outlet end and the flow tube adjacent to and spaced from the flow tube outlet end. The venturi forming connection may be inexpensively provided by forming the flow tube of a first portion connected to the inlet end of a reduced diameter with the second portion having an enlarged interior diameter extending to the flow tube outlet end. The entraining tube outlet end is connected to the flow tube enlarged internal diameter portion adjacent the area of the point of change in the flow tube internal diameter.

The flow tube can be secured to the transom by means of clamps or clips while the entraining tube is positioned within the interior of the boat and need not be supported in any particular way. Thus the entire device may be attached to a boat with two clamps secured to the exterior surface of the boat transom. No holes need be drilled in the boat. The possiblity of reverse siphoning is eliminated and the device functions to automatically bail water from the interior of the boat when the boat moves forward above a minimum speed without any requirement on the part of the boat operator to actuate the device.

Most boats have a drain hole in the transom immediately above the boat bottom. An alternate embodiment of the device is to extend the entraining tube through this drain hole and seal it. The entraining tube then may be clamped to the boat transom exterior surface in the same manner as the flow tube. In either arrangement, very minimal work is employed in attaching the automated drain system of this invention.

DETAILED DESCRIPTION OF THE PREFERRED EMBODIMENT

Figures 1, 2, 3, 4:
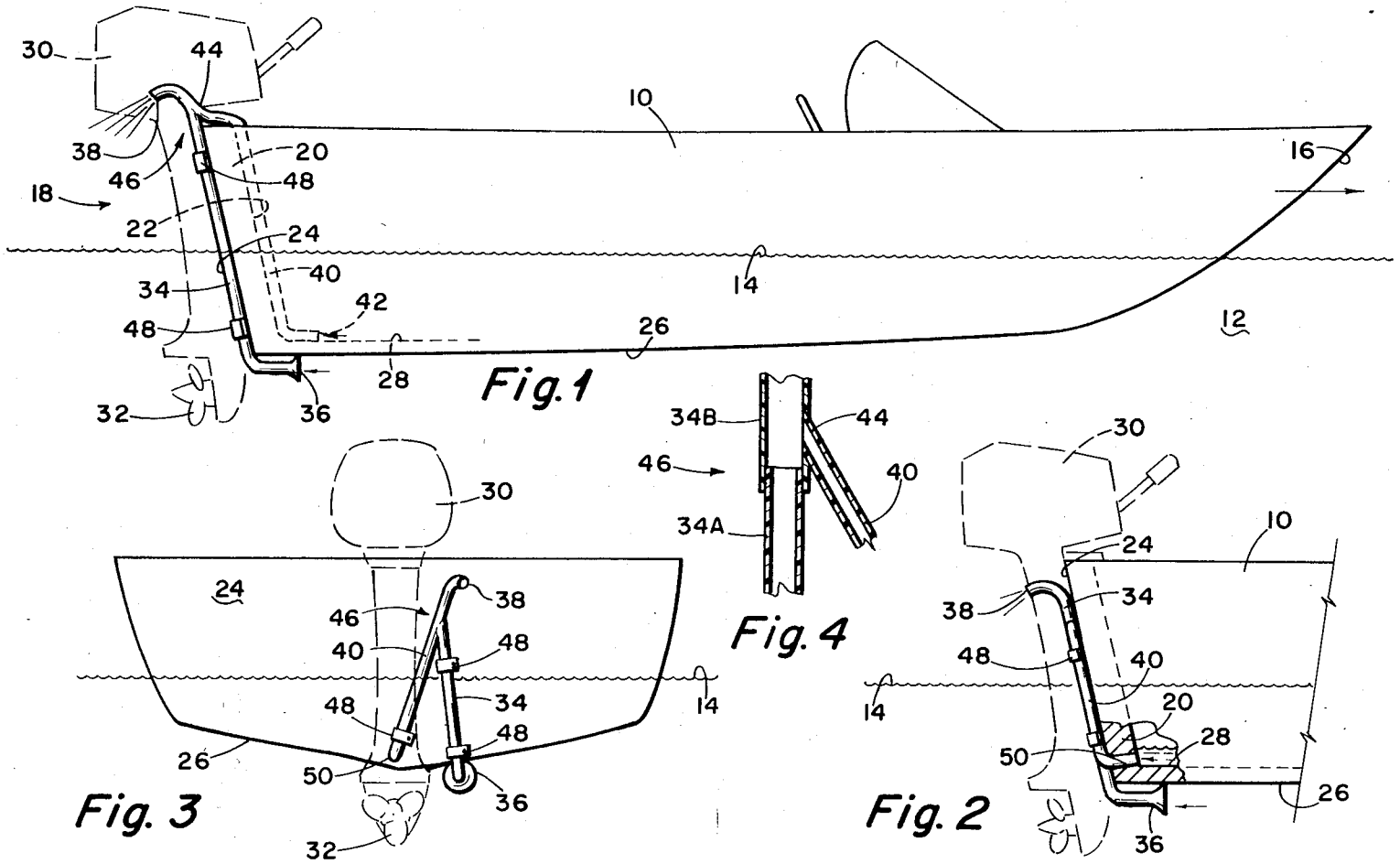
FIG. 1 is an elevational view of a typical pleasure boat positioned in the water with an outboard motor and showing the attachment of a drain for automatically siphoning water from the boat according to the present invention.
FIG. 2 is a view as in FIG. 1 but showing only the the rearward portion of a boat with an outboard motor secured to the boat transom and showing an alternate arrangement wherein the flow tube extends through the drain hole normally provided in the boat transom.
FIG. 3 is a rear view of the alternate arrangement of FIG. 2 showing the outboard motor in dotted outline and showing the method of supporting the drain to the exterior of the boat transom using clips.
FIG. 4 is an enlarged fragmentary view of the siphoning forming connection between the flow tube and the entraining tube wherein the venturi is formed by a change in the internal diameter of the flow tube.

Referring to the drawings and first to FIG. 1, a boat 10 is shown floating in water 12, the surface of the water being indicated by the numeral 14. Boat 10 may be of any type of boat such as used for sailing, fishing, skiing and so forth. Boat 10 has a bow end 16 and a stern end generally indicated by the numeral 18. The stern 18 of a pleasure boat is usually formed of a transom 20 having an inner surface 22 and an outer surface 24. The boat 10 has a bottom formed by an outer bottom surface 26 and an inner bottom surface 28. Boat 10 may be driven by an internal engine, by an inboard-outboard arrangement, or typically of smaller boats, by an outboard engine 30 having a propeller 32 below the water surface.

The object of the present invention is to provide a simple, easily attached and foolproof device for automatically bailing water out of the boat interior. The device is shown in bold outline in FIGS. 1, 2 and 3. In the arrangement of FIG. 1 the automatic drain device includes a flow tube 34 having an inlet end 36 and an outlet end 38, the outlet end being above the water surface 14. The flow tube inlet end 36 is positioned below the water surface 14 and in the direction facing towards the boat bow end 16. In the preferred arrangement, as illustrated, the inlet end 36 is below the boat bottom 26 immediately forwardly of the boat transom 20 and, to assist the automatic drain to function at lower boat speeds, the inlet end 36 may be flared as illustrated.

The second basic element of the automatic drain of this invention is an entraining tube 40 which has an inlet end 42 and an outlet end 44. In FIG. 1 the entraining tube 40 is positioned substantially entirely within the interior of boat 10 with the inlet end 42 adjacent the boat bottom interior 28.

The third element of the invention is a venturi forming connection 46 by which the entraining tube 40 is connected to the flow tube 34.

The venturi forming connection 46 may be arranged in a variety of ways. One way is to provide a flow restriction in the interior of the flow tube 34 immediately upstream of the connection with the entraining tube outer end 44. A venturi functions by creating a low pressure area within a flowing stream. The entraining tube is connected to this low pressure area so that the flow of water through the flow tube 34 as the boat moves through the water above a minimum speed will create a low pressure sufficient to provide a siphoning action in entraining tube 40.

One means of easily and economically accomplishing a venturi connection 46 is shown in FIG. 4. In this arrangement the flow tube 34 is formed of a lower, smaller internal diameter portion 34A and an upper, larger internal diameter portion 34B. Portion 34A connects with the flow tube inlet 36 and enlarged internal diameter portion 34B connects with the flow tube outlet 38. The outlet end 44 of the entraining tube 40 is connected to the enlarged internal diameter portion 34B immediately adjacent to the point of change of internal diameters. The arrangement of FIG. 4 is merely illustrative of various ways in which a venturi connection can be achieved.

In the arrangement of FIG. 1, as the boat moves through water at or above a minimum speed the water is forced to flow into the inlet of flow tube 34. It passes freely through the flow tube and out the outlet end 38. As it passes through the venturi connection 46 a reduced pressure zone is created which is applied to the entraining tube 44 to draw water from the interior of the boat which passes out through the entraining tube and the end portion of the flow tube. It can be seen that the device functions automatically and that it does not require any action on the part of the boat operator except to move the boat through the water above a preselected speed. In addition, with the position of juncture 46 above the water there is no possibility of reverse siphoning occurring since the opened outlet end 38 of the flow tube provides a siphon breaker, allowing air to flow into the venturi connection 46 to prevent the possibility of water being siphoned by the entraining tube and flow tube into the boat. Also it can be seen that if the flow tube inlet 38 encounters a rock or othe object it would be knocked away from the boat or perhaps broken off, but no damage would occur to the boat and no chance of flooding the boat would result.

The flow tube is preferably affixed to the transom rearward surface 24 such as by means of clips 48, each of which can be held in place by one or two screws.

Most boats have a drain opening 50 in the transom 20 adjacent the boat interior surface 28 as shown in FIG. 2. This drain opening is provided by the manufacturer to enable the boat to be drained after it is removed from the water or it can be opened when the boat is moving at a faster speed, that is, a speed above a minimum level, and if opened while moving forwardly at a fast speed, the drain opening 50 can be used to drain water from the interior of the boat. However, if the operator forgets to close the opening 50 when the boat stops, or even when it slows down below a minimum speed, the boat will soon be filled with water. The present invention can make use of the drain opening 50 by extending the entraining tube 40 through the opening and sealing it. In this way, most of the automatic boat drain is attached to the rearward exterior surface of the boat transom as shown in FIGS. 2 and 3. The entire device can be held to the boat transom rearward surface 24 by means of clips 48. The arrangements of FIGS. 2 and 3 functions in the same way as that of FIG. 1. The advantage of the arrangement of FIG. 1 is that no portion of the device passes through any portion of the boat and therefore the possibility of leakage at an opening, such as at the drain opening 50, is eliminated.

The invention described fulfills all of the objectives initially set forth. The automatic boat drain device may be made entirely of plastic, however, clips 48 may be of metal. The device can be made inexpensively and can be installed without the requirement of professional help. Of most importance is the fact that no possibility of reverse siphoning can fill the boat and the device functions automatically without requiring the attention of the boat operator.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. For use with a boat having a bow end and a stern end, the stern end being formed by a transom having an interior and an exterior surface and an upper edge, an automatic drain for automatically siphoning water from the boat interior when the boat moves forward through water at or above a minimum speed, the automatic drain comprising:

a flow tube secured to the exterior surface of the boat transom, the flow tube having an inlet and outlet end, the inlet end extending below the water surface and under the boat immediately forward of the transom, and being open in the direction towards the boat bow end, the flow tube having the outlet end above the water surface;

an entraining tube substantially contained within the interior of the boat and having an inlet end and an outlet end, the inlet end being positioned adjacent the interior bottom of the boat; and a venturi forming connection positioned at the top of the transom upper edge and between said entraining tube outlet end and said flow tube adjacent to and spaced from said flow tube outlet end, whereby no part of the drain is required to penetrate the boat.

2. A drain for automatically siphoning water from a boat according to claim 1 wnerein said venturi connection is formed by means of an increase in internal diameter of said flow tube in the direction towards said outlet end, said outlet end of said entraining tube being connected to said increased diameter portion of said flow tube adjacent the point of diameter increase.

3. For use with a boat having a bow end and a stern end, the stern end being formed by a transom having an interior and an exterior surface and having a small diameter opening through the transom adjacent the bottom of the boat, an automatic drain for automatically siphoning water from the boat interior when the boat moves forward through water at or above a minimum speed, the automatic drain comprising:

a flow tube secured to the exterior surface of the boat transom, the flow tube having an inlet and outlet end, the inlet end extending below the water surface, and being open in the direction towards the boat bow end, the flow tube having an outlet end above the water surface;

an entraining tube secured to the exterior surface of the boat transom and having an inlet end and an outlet end, the inlet end portion extending through the opening in the boat transom, the inlet end being positioned within the boat and adjacent the interior bottom of the boat; and a venturi forming connection positioned above the water surface and between said entraining tube outlet end and said flow tube adjacent to and spaced from said flow tube outlet end, and being secured to the exterior surface of the boat transom.

* * * * *